US009687992B2

(12) United States Patent
Yamamoto

(10) Patent No.: US 9,687,992 B2
(45) Date of Patent: Jun. 27, 2017

(54) SLICER

(71) Applicant: BENRINER CO., LTD, Yamaguchi (JP)

(72) Inventor: Hajime Yamamoto, Yamaguchi (JP)

(73) Assignee: Benriner Co., LTD, Yamaguchi (JP)

( * ) Notice: Subject to any disclaimer, the term of this patent is extended or adjusted under 35 U.S.C. 154(b) by 17 days.

(21) Appl. No.: 14/539,256

(22) Filed: Nov. 12, 2014

(65) Prior Publication Data

US 2015/0375412 A1 Dec. 31, 2015

(30) Foreign Application Priority Data

Jun. 30, 2014 (JP) ..... 2014-133575

(51) Int. Cl.
*B26D 1/02* (2006.01)
*B26D 3/28* (2006.01)

(52) U.S. Cl.
CPC ..... *B26D 3/283* (2013.01); *B26D 2003/286* (2013.01)

(58) Field of Classification Search
CPC ..... B26D 3/283; B26D 2003/286
USPC ..... 83/425.3, 856, 932
See application file for complete search history.

(56) References Cited

U.S. PATENT DOCUMENTS

2002/0174754 A1* 11/2002 Vincent ..... A47J 43/25 83/247
2004/0231482 A1* 11/2004 Boilen ..... B26D 3/283 83/425.3
2005/0028685 A1* 2/2005 Yamamoto ..... A47J 43/25 99/537
2011/0132161 A1* 6/2011 Robbins ..... B26D 3/283 83/13
2014/0060278 A1* 3/2014 Koide ..... B26D 3/283 83/699.11
2014/0366699 A1* 12/2014 Wong ..... B26D 3/283 83/698.11
2015/0231791 A1* 8/2015 Robbins ..... B26D 3/283 83/564

FOREIGN PATENT DOCUMENTS

CN 2913164 A1 * 9/2015 ..... B26B 3/03
JP 2004-338069 12/2004
JP 2011-156435 8/2011

* cited by examiner

*Primary Examiner* — Omar Flores Sanchez

(74) *Attorney, Agent, or Firm* — Fattibene and Fattibene LLC; Paul A. Fattibene

(57) ABSTRACT

A slicer that can slice a material to be sliced with a uniform thickness and can also be used sanitarily. A slicer 1 which includes a slice width adjusting mechanism 100 that is provided with a slice width adjusting dial 60 having a cylindrical shape that has a screw portion 62 formed on an outer peripheral surface and is capable of supporting the rear surface 40*c* of a movable supporting plate 40, a screw receiving hole 13 that is integrally formed with a frame 10 and capable of being engaged with the screw portion 62, and a first rib 45 that is formed on the rear surface 40*c* of the movable supporting plate 40 so as to stand thereon and capable of being fitted into the slice width adjusting dial 60.

7 Claims, 8 Drawing Sheets

SLICER

BACKGROUND OF THE INVENTION

Field of the Invention

The present invention relates to a slicer for slicing a material to be sliced, such as a vegetable, fruit or the like, and in particular concerns a slicer capable of desirably adjust a slicing width of the material to be sliced.

Description of the Related Art

Conventionally, as a slicer for use in easily slicing various materials to be sliced, such as vegetables, fruits or the like, into sliced pieces having a desired width, such a slicer has been used in which the material to be sliced is reciprocally moved forward and rearward in the slicing direction so as to slice the material to be sliced by using a slicing blade.

As a conventional slicer, such a slicer has been known which is provided with a frame having a pair of right and left supporting arms, a slicing blade with two ends thereof being secured to the supporting arms, a fixed supporting plate that is placed on the front side of the slicing blade and passed between a pair of right and left frame portions, and a movable supporting plate that is placed on the rear side of the slicing blade, with the slicing width (thickness) of a sliced material width being made adjustable by moving the movable supporting plate in a vertical direction.

As the movable supporting plate of this slicer, a structure has been known in which its two ends are journaled to the paired right and left supporting arms so as to be able to rock in vertical directions (for example, see JP-A No. 2004-338069), and another structure has been known in which it is movable horizontally in vertical directions by a spacer disposed below a movable receiving plate (for example, see JP-A No. 2011-156435).

[Patent Document 1] JP-A No. 2004-338069

[Patent Document 2] JP-A No. 2011-156435

In the case of the above-mentioned former slicer, however, as shown in FIGS. 7A and 7B, a movable supporting plate 91 is positioned so as to be tilted downward in a vertical direction H, with a slicing blade 92 being diagonally disposed relative to a slicing direction S, that is, with a distance between the movable supporting plate 91 and the slicing blade 92 being gradually widened from one of the ends in a width direction W toward the other end; therefore, in the case when a material M to be sliced is long in the width direction W, a problem arises in which deviations occur between a thickness ta of its cut portion a on the one of the end sides in the width direction W of a sliced piece C and a thickness tb of its cut portion b on the other end side.

Moreover, since the slicing blade 92 that is intruded to a material M to be sliced horizontally slices the material to be sliced, a problem arises in which in the case when a material to be sliced is long in a slicing direction S, as shown in FIGS. 8A to 8D, deviations occur in the thicknesses of a sliced piece C before and after the slicing direction S, that is, a thickness tc on the tip side in the slicing direction S of the sliced piece C and a thickness td on the rear side are different from each other.

Furthermore, in the case of the above-mentioned latter slicer, since the movable supporting plate assembled onto the frame is not easily removed from the frame, cut chips of the material to be sliced tend to be caught in a gap between the movable supporting plate and the spacer, or waste water containing soil or the like adhering to the surface of a material to be sliced tends to remain in the gap, with the result that sanitation might become poor as the slicer is used.

In the case of a slicer in which a movable supporting plate made of resin is used, since upon slicing a material to be sliced, the movable supporting plate is deflected downward in the vertical direction by a pressing force exerted onto the material to be sliced, the gap between the slicing blade and the movable supporting plate is widened beyond a predetermined gap between the slicing blade and the movable supporting plate, the sliced pieces tend to become thicker than the intended thickness.

Therefore, in order to slice the material to be sliced with a uniform thickness and also to provide a slicer capable of being used sanitarily, there are some technical problems to be solved, and the object of the present invention is to solve these problems.

SUMMARY OF THE INVENTION

The present invention, which has been proposed to achieve the above object, includes an invention according to an embodiment that provides a slicer including: a frame, a slicing blade with its two ends being supported by the frame, a movable supporting plate that supports a material to be sliced when the material to be sliced is moved to slide toward the slicing blade, and a slice width adjusting mechanism capable of adjusting the slicing width of the material to be sliced by raising and lowering the movable supporting plate in vertical directions, and in this structure, the slice width adjusting mechanism is provided with: a slice width adjusting dial having a cylindrical shape that has a screw portion formed on an outer peripheral surface, and is capable of supporting the rear surface of the movable supporting plate horizontally, a screw receiving hole that is integrally formed with the frame and capable of being engaged with the screw portion and a rib that is formed to stand on the rear surface of the movable supporting plate and can be fitted into the slice width adjusting dial.

In accordance with this structure, since the movable supporting plate is raised and lowered with its horizontal state being maintained by the slice width adjusting dial, the slice width adjusting dial is positioned at a desired position in a height direction in accordance with an engaged state between the screw portion and the screw receiving hole; therefore, since the movable supporting plate is raised and lowered depending on the position of the slice width adjusting dial, with its horizontal state being maintained, it becomes possible to slice a material to be sliced with a uniform thickness regardless of the size of the material to be sliced.

Moreover, by allowing the slice width adjusting dial to support the rear surface of the movable supporting plate without a gap, it is possible to prevent cut chips and waste water from remaining between the slice width adjusting dial and the movable supporting plate, and consequently to sanitarily use the slicer.

Furthermore, since the rib is formed on the rear surface of the movable supporting plate, the rigidity of the movable supporting plate is increased so that it becomes possible to prevent the movable supporting plate from being deflected downward by a pressing force exerted when the movable supporting plate slices a material to be sliced.

An invention disclosed in one embodiment provides a slicer in which, in addition to the structure of the slicer of another embodiment, the movable supporting plate has an easily deflecting region that is formed on the front side in the slicing direction as a narrowed portion along the slicing directions in which the material to be sliced is allowed to slide upon slicing the material to be sliced, with at least one portion of the slice width adjusting dial being made to support the inside of the easily deflecting region.

In accordance with this structure, since the slice width adjusting dial supports the movable supporting plate within the easily deflecting region of the movable supporting plate it becomes possible to further prevent the movable supporting plate from being deflected downward by a pressing force exerted when the movable supporting plate slices a material to be sliced.

An invention disclosed in another embodiment provides a slicer in which, in addition to the structure of the slicer of one embodiment, the movable supporting plate has an easily deflecting region that is formed on the front side in the slicing direction as a narrowed portion along the slicing directions in which the material to be sliced is allowed to slide upon slicing the material to be sliced, with at least one portion of the rib being disposed inside the easily deflecting region.

In accordance with this structure, since the rib is disposed within the easily deflecting region of the movable supporting plate, it becomes possible to further prevent the movable supporting plate from being deflected downward by a pressing force exerted when the movable supporting plate slices a material to be sliced.

An invention disclosed in another embodiment provides a slicer in which, in addition to the structure of the slicer of other embodiments, the frame is provided with a guide groove formed as a concave portion in a direction perpendicular to the inner peripheral surface, and the movable supporting plate has guide pins that are attached to two sides thereof in the width direction orthogonal to the slicing direction, and capable of being engaged with the guide groove.

In accordance with this structure, since the movable supporting plate is raised and lowered upward and downward, it is possible to easily position-determine the movable supporting plate.

An invention disclosed in another embodiment provides a slicer in which, in addition to the structure of the slicer according to a different embodiment, the guide groove is formed on the rear surface of the frame in a direction perpendicular thereto so as to be opened therefrom, and the guide pin of the movable supporting plate is attachably detached from the guide groove through the opening of the guide groove.

In accordance with this structure, since the movable supporting plate can be detached from the frame, it becomes possible to easily wash the movable supporting plate.

An invention disclosed in another embodiment provides a slicer in which, in addition to the structure of the slicer of other embodiments, in the case when the movable supporting plate is divided into a tip portion, a center portion and a rear portion from the tip to the rear end in the slicing direction, the rib is disposed in a manner so as to bridge over the tip portion and the center portion of the movable supporting plate.

In accordance with this structure, since the rib is formed over a wide range of the movable supporting plate, it is possible to prevent the movable supporting plate from being deflected downward by a pressing force exerted when the movable supporting plate slices a material to be sliced.

Effects of the Invention

Since the slicer in accordance with the present invention raises and lowers the movable supporting plate horizontally while suppressing the deflection of the movable supporting plate, it becomes possible to slice a material to be sliced with a uniform thickness regardless of the size of the material to be sliced, and also to suppress cut chips and waste water from remaining; thus, the slicer can be sanitarily used.

BRIEF DESCRIPTION OF THE DRAWINGS

FIG. 1A is a perspective view showing the surface side of the slicer; and FIG. 1B is a perspective view showing the rear surface side of the slicer.

FIG. 2A is a plan view showing a surface side of the frame; FIG. 2B is a bottom face view showing a rear surface side of the frame; and FIG. 2C is a cross-sectional view taken along line IIC-IIC in FIG. 2A.

FIG. 3B is a bottom face view showing a rear surface side of the movable supporting plate; FIG. 3C is a side view of the movable supporting plate; and FIG. 3D is a cross-sectional view taken along line IIID-IIID in FIG. 3A.

FIG. 4A is a perspective view showing the slice width adjusting dial; FIG. 4B is a plan view of the slice width adjusting dial; and FIG. 4C is a cross-sectional view taken along line IVC-IVC in FIG. 4B.

DETAILED DESCRIPTION OF THE PREFERRED EMBODIMENTS

In order to achieve the object for providing a slicer that can slice a material to be sliced with a uniform thickness and is capable of being used sanitarily, the present invention is provided with a slicer including: a frame, a slicing blade with its two ends being supported by the frame, a movable supporting plate that supports a material to be sliced when the material to be sliced is moved to slide toward the slicing blade, a slice width adjusting mechanism capable of adjusting the slicing width of the material to be sliced by raising and lowering the movable supporting plate in vertical directions, and in this structure, the slice width adjusting mechanism is provided with: a slice width adjusting dial having a cylinder shape that has a screw portion formed on an outer peripheral surface, and is capable of supporting the rear surface of the movable supporting plate horizontally, a screw receiving hole that is integrally formed with the frame and capable of being engaged with the screw portion and a rib that is formed to stand on the rear surface of the movable supporting plate and fitted into the slice width adjusting dial; thus, it becomes possible to achieve the object.

Embodiments

Referring to Figs., the following description will discuss one embodiment relating to a slicer 1 in accordance with the present invention. Additionally, in the following description, terms "front" and "rear" correspond to the front side and the rear side in a slicing direction that is coincident with a feeding direction of a material to be sliced at the time of slicing the material to be sliced. Moreover, terms "up" and "down" correspond to the upper side and the downward side in a perpendicular direction to the slicer.

Figure 1A:
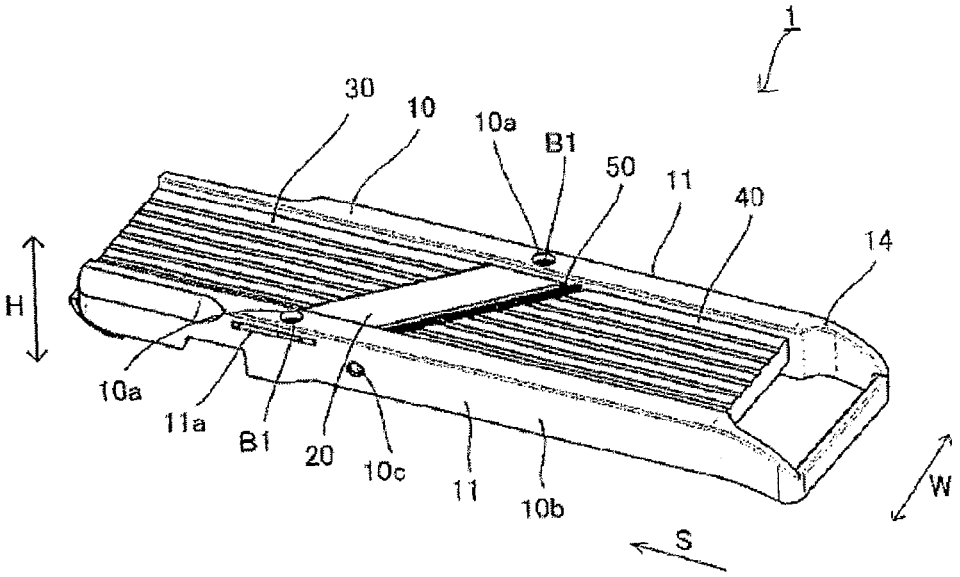
FIGS. 1A and 1B are drawings that show a slicer in accordance with one embodiment of the present invention.
Figure 1B:
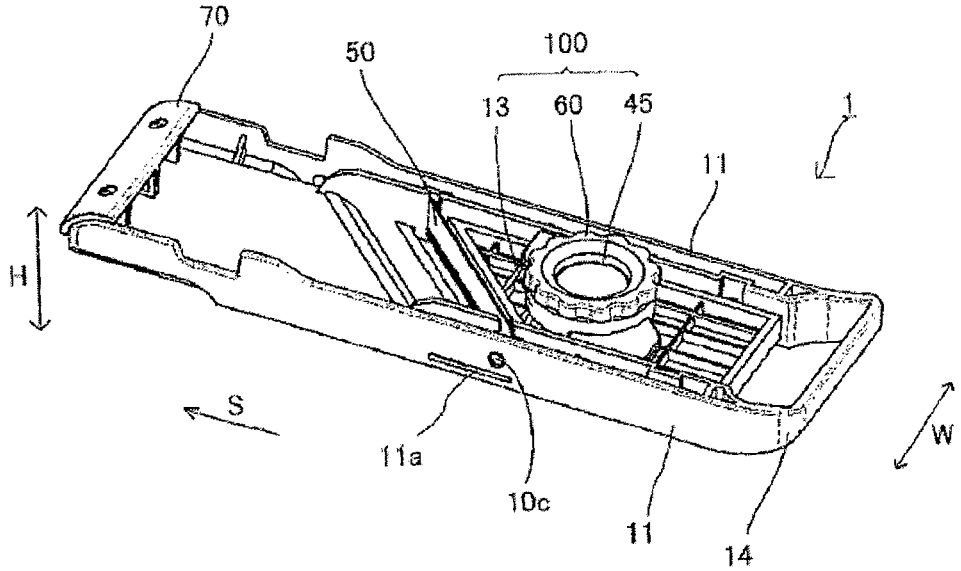

As shown in FIG. 1A and FIG. 1B, the slicer 1 is provided with a frame 10, a slicing blade 20 for slicing a material to be sliced, a fixed supporting plate 30 disposed on the front side of the slicing blade 20, a movable supporting plate 40 disposed on the rear side of the slicing blade 20, an exchange blade 50 that is exchangeable, and a slicing width adjusting mechanism 100 that position-determines the movable supporting plate 40 at a desired position in the vertical direction by the slicing width adjusting dial 60. The frame 10, the fixed supporting plate 30, the movable supporting plate 40 and the slicing width adjusting dial 60 are respectively made of an ABS resin and produced by an injection molding process. The slicing blade 20 and the exchange blade 50 are made of stainless steel.

The slicer 1 is designed such that when a user reciprocally moves a material to be sliced in a slicing direction S while pressing the material to be sliced onto the movable supporting plate 40, the material to be sliced is sliced into sliced pieces having a thickness in accordance with a gap between the slicing blade 20 and the movable supporting plate 40. The sliced pieces are discharged from the rear side of the slicer 1.

The slicing blade 20 is extended diagonally to the width direction W of the frame 10. On the right and left sides of the slicing blade 20, holes, not shown, are respectively formed. The slicing blade 20 is fastened to the frame 10 by bolts B1 inserted through securing holes 10*a* formed on the surface of the frame 10 and the holes of the sliding blade 20. Additionally, the fastening method is not limited by a fastening method by the use of bolts, and any method may be used as long as the slicing blade 20 is secured onto the frame 10.

The exchange blade 50 is attached between the slicing blade 20 and the movable supporting plate 40. The exchange blade 50 has its two ends supported by the frame 10. The exchange blade 50 is provided with a plurality of teeth formed in the longitudinal direction of the exchange blade 50 so that notches can be formed in the material to be sliced along the slicing direction S in accordance with the gap of the respective teeth. The exchange blade 50 is secured by being pressed onto the frame 10 by bolts, not shown, that are inserted in bolt through holes 10*c* formed on outside surfaces 10*b* of the frame 10. By using the slicing blade 20 and the exchange blade 50 in combination, the material to be sliced can be sliced into various stick shapes or stripe shapes having large and small sizes.

The movable supporting plate 40 and the slice width adjusting dial 60 are detachably attached to the frame 10 so that the respective members can be washed individually.

The slicer 1 is provided with an anti-slipping member 70 attached to the tip thereof in the slicing direction S. The anti-slipping member 70 has an anti-slipping layer made of resin on its surface. The anti-slipping member 70 has its ridge-line cross-sectional shape in the slicing direction S formed in a manner so as to be curved into a convex shape, and when the user uses the slicer 1, the anti-slipping member 80 is diagonally pushed onto a chopping board or the like so that it is possible to slice the material to be sliced, without the slicer 1 being slipped.

Figure 2A:
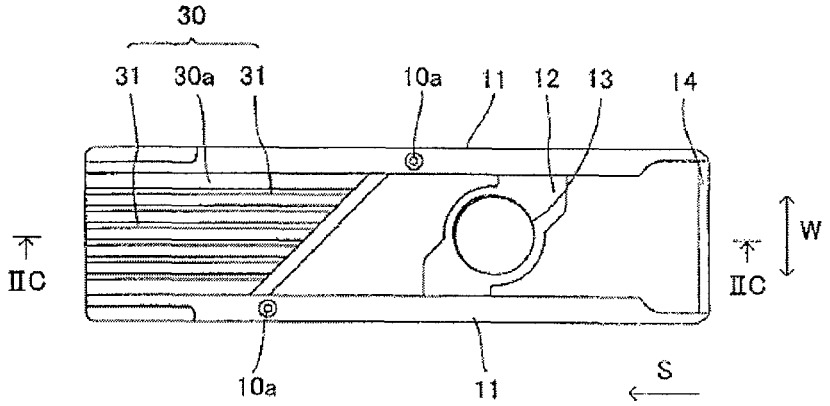
FIGS. 2A to 2C are drawings that show a frame and a fixed supporting plate.
Figure 2B:
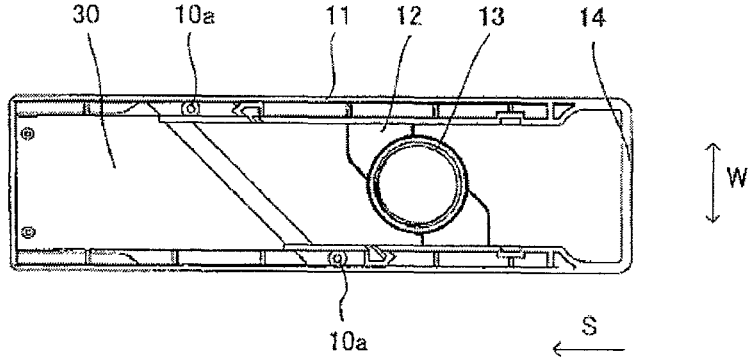
Figure 2C:
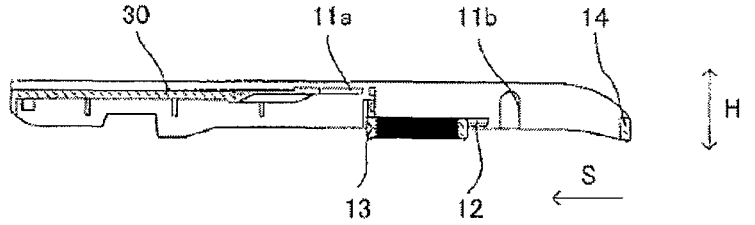
Figure 3A:
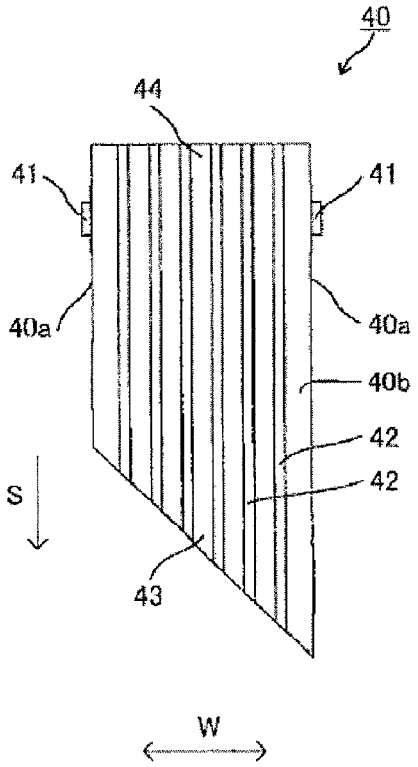
FIGS. 3A to 3D are drawings that show the movable supporting plate of FIG. 1.
Figure 3B:
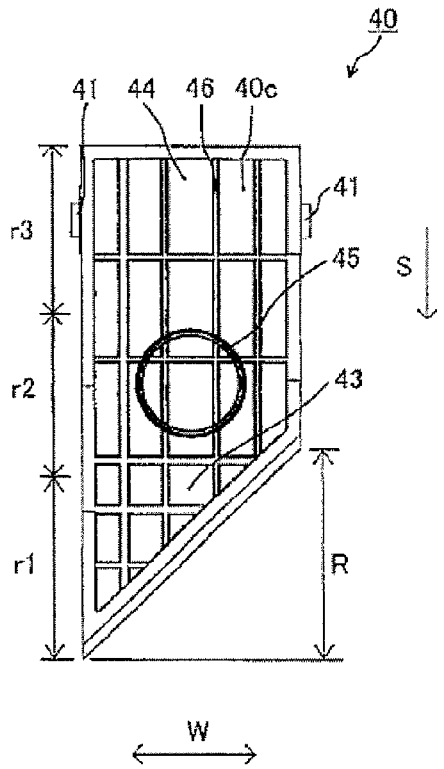
Figure 3C:
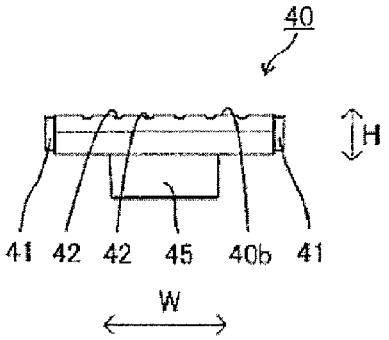
Figure 3D:
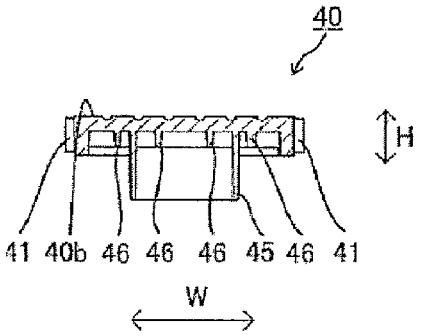

As shown in FIGS. 2A to 2C, the frame 10 is provided with a pair of right and left supporting arms 11 attached to the two ends in the width direction of the fixed supporting plate 30, a stay 12 that is passed between the right and left paired supporting arms 11, and a screw receiving hole 13 to be described later, which is formed virtually in the center of the stay 12 and can be engaged with a slicing width adjusting dial.

The supporting arm 11 is provided with slits 11*a* that are formed on the inner surfaces and house two ends of the slicing blade 20. The slicing blade 20 is inserted from the slits 11*a* and disposed at a predetermined position.

The supporting arm 11 is provided with a guide groove 11*b* formed with a concave shape on the inside surface. The guide groove 11*b* is formed so as to extend in a perpendicular direction H. The guide groove 11*b* is designed to be engaged with a guided pin 41 to be described later of the movable supporting plate 40. Additionally, the shape of the guide groove 11*b* may be set desirably. Since the lower portion in the perpendicular direction H of the guide groove 11*b* is formed so as to be opened. The movable supporting plate 40 can be attachably detached from the frame 10.

The frame 10 is provided with a handle 14 that is held by the user. In the present embodiment, the handle 14 is integrally combined with the rear end of the supporting arm 11; however, the handle 14 may have a structure to be detachably attached and fastened by using bolts, as long as it can be secured to the supporting frame 11.

The fixed supporting plate 30 is disposed between the paired supporting arms 11, and integrally attached to the supporting arm 11. On the surface 30*a* of the fixed supporting plate 30, 8 rows of groove portions 31 are engraved and formed side by side in the width direction W in an extended manner in the slicing direction S. By forming the groove portions 31 on the surface 30*a* of the fixed supporting plate 30, the fixed supporting plate 30 and the material to be sliced are made in contact with each other with a reduced area so that the material to be sliced can be moved smoothly. The depth dimension of the groove portions 31 may be desirably determined.

As shown in FIG. 3A to 3D, the movable supporting plate 40 is provided with pins 41 to be guided, formed on the rear side of the side faces 40*a* so as to protrude therefrom. The pins 41 to be guided are designed to be engaged with the guide grooves 11*b* of the supporting arm 11 so that the movable supporting plate 40 is raised and lowered in accordance with the shape of the guide grooves 11*b*. For example, in the case when each guide groove 11*b* is formed from the lower side to the upper side in the perpendicular direction H, as well as diagonally from the rear side toward the front side in the slicing direction S, the movable supporting plate 40 is also diagonally raised and lowered in accordance with the shape of each of the guide grooves 11*b*. When the movable supporting plate 40 is raised, the guided pin 41 is engaged with the guide groove 11*b* so that wobbling and twisting of the movable supporting plate 40 are regulated.

On the surface 40*b* of the movable supporting plate 40, 8 rows of groove portions 42 are engraved and formed side by side in the width direction W in an extended manner in the slicing direction S. By forming the groove portions 42, the contact area between the movable supporting plate 40 and the material to be sliced is reduced correspondingly so that the sliding resistance upon slicing the material to be sliced is reduced.

The tip portion 43 of the movable supporting plate 40 is formed so as to be gradually narrowed from the vicinity of the center of the movable supporting plate 40 toward the front side in the slicing direction S, and at the vicinity of the tip of the movable supporting plate 40, an easily deflecting region R that is easily deflected downward by a pressing force that presses the material to be sliced downward upon slicing the material to be sliced. More specifically, the easily deflecting region R is formed at a tip portion 43 that is formed to have a width narrower than that of the rear end portion 44, with a reduced rigidity. That is, when, upon slicing the material to be sliced, a pressing force that presses the material to be sliced downward is exerted on the movable supporting plate 40, the tip portion 43 having a rigidity lower than that of the rear end portion 44 is easily deflected downward locally. In the present embodiment, the easily deflecting region R is formed over virtually a half portion of the length dimension of the movable supporting plate 40 from the tip of the movable supporting plate 40 toward the rear end.

Moreover, on the rear surface 40*c* of the movable supporting plate 40, a first rib 45, which is disposed so as to include one portion of the easily deflecting region R and improves the rigidity of the easily deflecting region R, is formed. The first rib 45 is formed into a tapered shape that is gradually expanded in its diameter from the lower side in the perpendicular direction H upward so that with this structure, the movable supporting plate 40 is easily removed from a metal mold.

In the present embodiment, the first rib 45 is formed into a hollow cylindrical shape; however, any shape may be adopted as long as the rigidity of the movable supporting plate 40 is increased, and for example, a solid cylindrical shape may be used, or an ellipsoidal shape or the like may be used.

Supposing that the movable supporting plate 40 is divided into three equal portions, that is, a tip region r1, a center region r2, and a rear end region r3, successively from the tip side in the slicing direction S, the first rib 45 is formed in a manner so as to bridge over the tip region r1 and the center region r2. That is, the first rib 45 is formed within ⅔ of the length dimension of the movable supporting plate from the tip toward the rear end in the slicing direction S of the movable supporting plate 40. Thus, the rigidity of the movable supporting plate 40 is increased so that the movable supporting plate 40 is suppressed from deflecting downward upon receipt of a pressing force exerted at the time of slicing the material to be sliced.

On the rear surface 40*c* of the movable supporting plate 40, a second rib 46 disposed into a lattice pattern is formed. Thus, the rigidity of the movable supporting plate 40 is further increased.

Figure 4A:
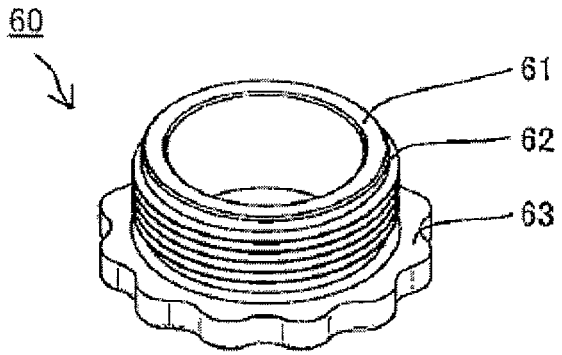
FIGS. 4A to 4C are drawings that show the slice width adjusting dial of FIG. 1.
Figure 4B:
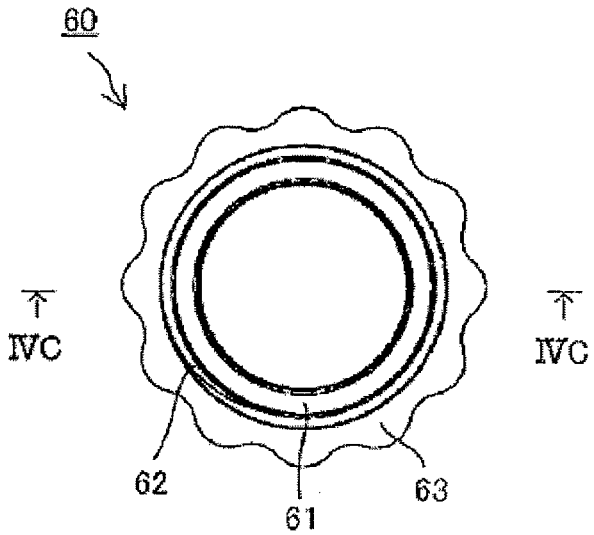
Figure 4C:
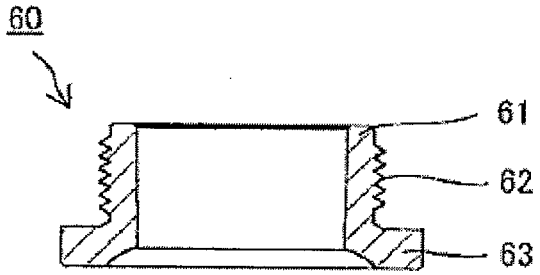

As shown in FIGS. 4A to 4C, the slice width adjusting dial 60 is provided with a main body unit 61 having a hollow cylindrical shape, a screw portion 62 formed on the outer peripheral surface of the main body unit 61 and a handle 63 formed on the base end of the main body unit 61.

The inner diameter of the main body unit 61 is formed to have a larger diameter than the outer diameter of the first rib 45.

The screw portion 62 is capable of being engaged with the screw receiving hole 13.

The handle 63 is held by the user when the user rotates the slice width adjusting dial 60 to vertically raise or lower the movable supporting plate 40.

Next, referring to FIGS. 5A to 5D, the following description will discuss the slice width adjusting mechanism 100. Additionally, the slice width is adjustable by raising or lowering the movable supporting plate 40 relative to the slicing blade 20, and the sequence of processes for lowering the movable supporting plate 40 is reversed to the sequence of processes for raising the movable supporting plate 40; therefore, the following description will discuss the function of the slice width adjusting mechanism 100 by exemplifying the process for raising the movable supporting plate 40.

The slice width adjusting mechanism 100 is constituted by the screw receiving hole 13 of the frame 10, the first rib 45 of the movable supporting plate 40 and the slice width adjusting dial 60.

Figure 5A:
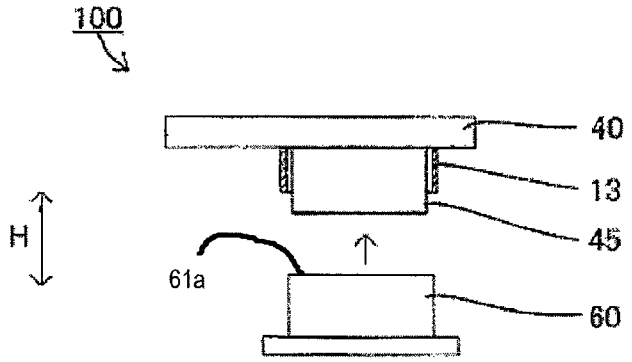
FIGS. 5A to 5D are a schematic view that explains the action of the slice width adjusting dial.
Figure 5B:
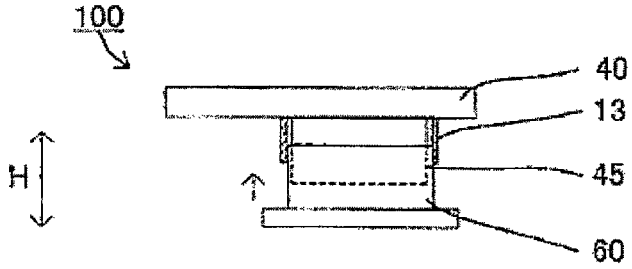
Figure 5C:
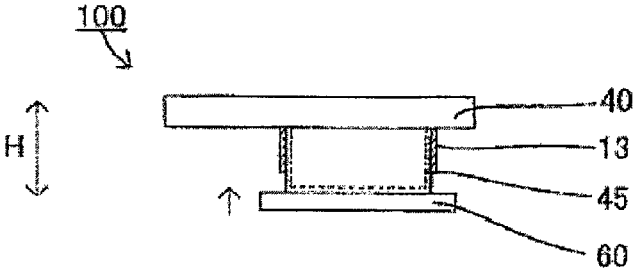
Figure 5D:
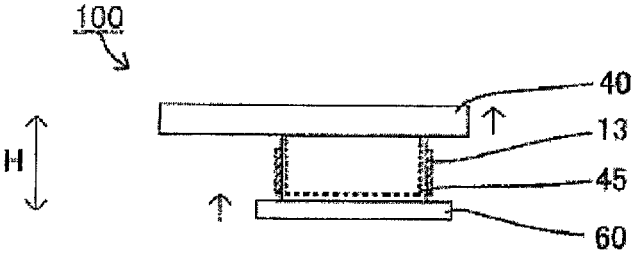
Figure 6A:
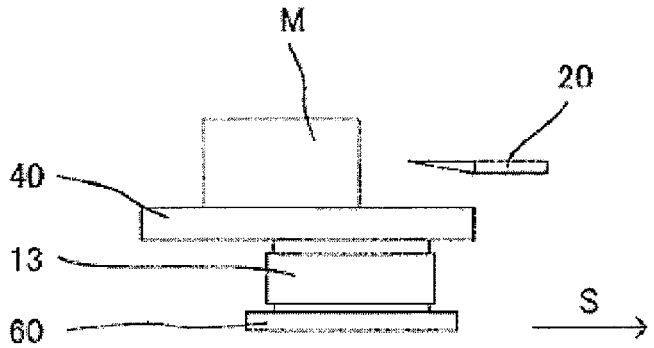
FIGS. 6A to 6D are a schematic view that shows a state in which a material to be sliced is sliced by using the slice width adjusting dial.
Figure 6B:
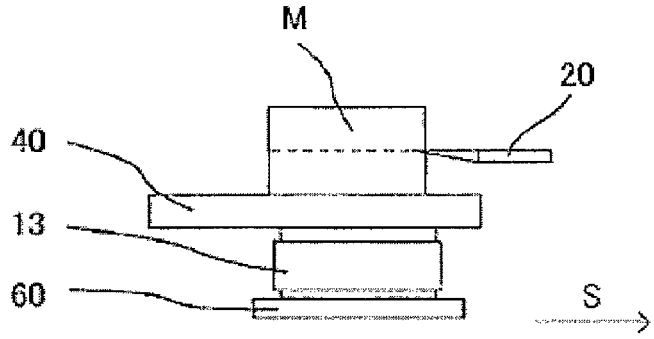
Figure 6C:
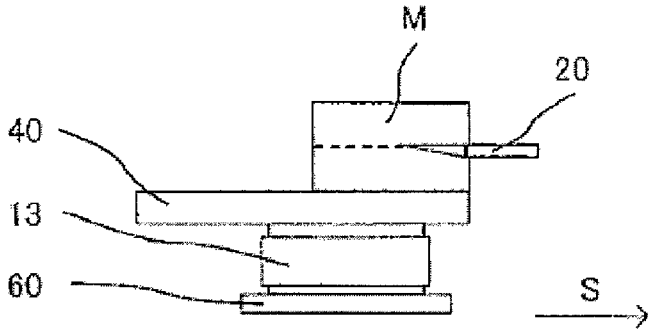
Figure 6D:
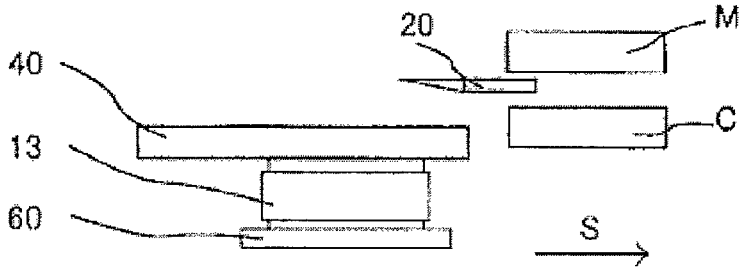
Figure 7A:
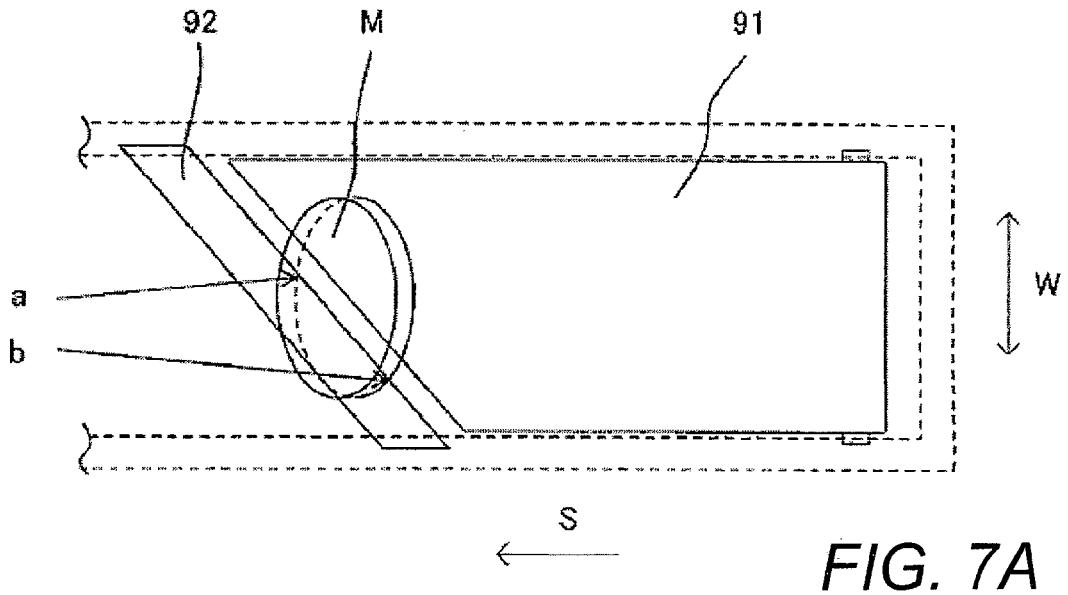
FIG. 7A (PRIOR ART)
FIGS. 7A to 7B are a schematic view that explains a deviation in the slice width in the width direction in a conventional slicer.
Figure 7B:
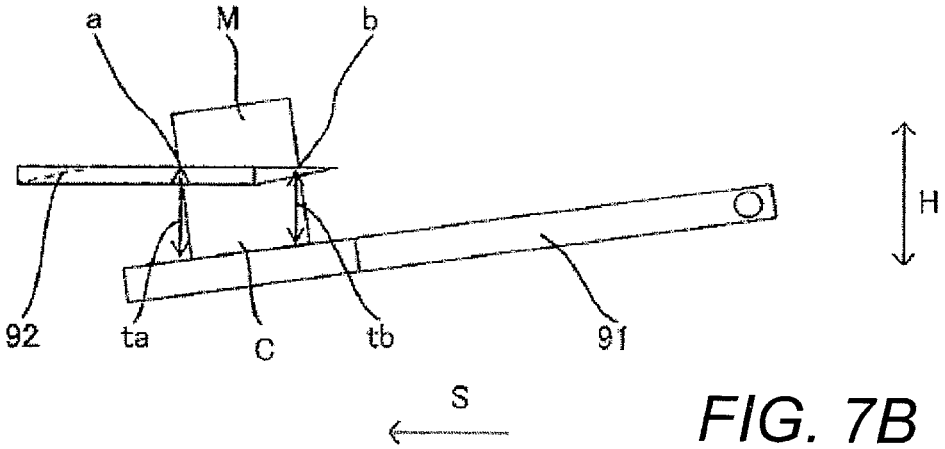
FIG. 7B (PRIOR ART)
Figure 8A:
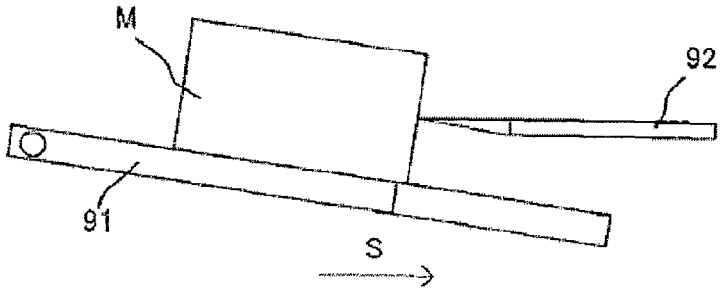
FIG. 8A (PRIOR ART)
FIGS. 8A to 8D are a schematic view that explains a deviation in the slice width in the slicing direction in the conventional slicer.
Figure 8B:
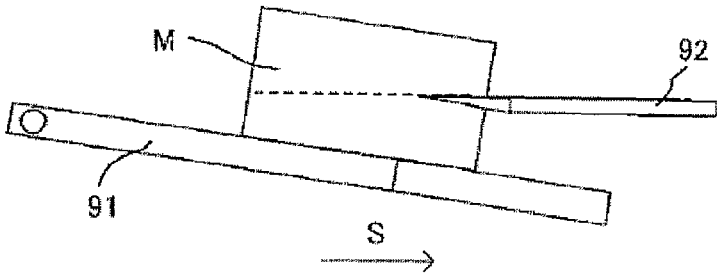
FIG. 8B (PRIOR ART)
Figure 8C:
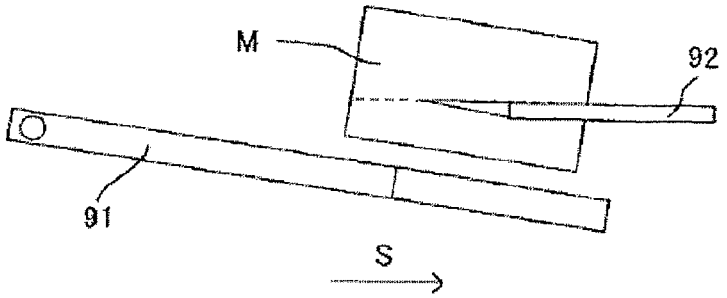
FIG. 8C (PRIOR ART)
Figure 8D:
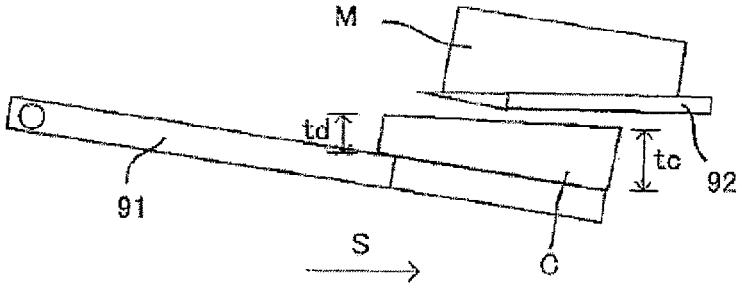
FIG. 8D (PRIOR ART)

FIGS. 5A to 5D are a schematic view that explains the action of the slice width adjusting mechanism 100, with the screw receiving hole 13, the first rib 45 and the slice width adjusting dial 60 being omitted. FIG. 5A is a view showing a state before the slice width adjusting screw 60 is engaged with the screw receiving hole 13; FIG. 5B is a view showing a state in which the slice width adjusting screw 60 is engaged with the screw receiving hole 13; FIG. 5C is a view showing a state in which the slice width adjusting screw 60 is made to screw forward; and FIG. 5D is a view showing a state in which slice width adjusting screw 60 is made to further screw forward.

First, as shown in FIG. 5A, before the slice width adjusting screw 60 is engaged with the screw receiving hole 13, the first rib 45 of the movable supporting plate 40 is inserted through the screw receiving hole 13

Next, as shown in FIG. 5B, the slice width adjusting screw 60 is engaged with the screw receiving hole 13. At this time, the first rib 45 of the movable supporting plate 40 is housed in a nested state inside the main body unit 61 of the slice width adjusting screw 60.

When the slice width adjusting screw 60 is rotated to screw forward, as shown in FIG. 5C, the slice width adjusting screw 60 is raised relative to the screw receiving hole 13 so that the top surface 61*a* of the main body unit 61 is made in contact with the rear surface 40*c* of the movable supporting plate 40. At this time, the top surface 61*a* of the main body unit 61 comes into contact with the rear surface 40*c* of the movable supporting plate 40 between the first rib 45 and the second rib 46.

When the slice width adjusting screw 60 further screws forward, as shown in FIG. 5D, the slice width adjusting screw 60 raises the movable supporting plate 40. At this time, since the movable supporting plate 40 is supported by the entire surface of the top surface 61*a* of the slice width adjusting screw 60 so that the movable supporting plate 40 is raised in a stable manner.

After the movable supporting plate 40 has been raised until the gap between the slicing blade 20 and the movable supporting plate 40 has reached a desired slice width, the rotation of the slice width adjusting screw 60 is stopped so that the movable supporting plate 40 is supported by the slice width adjusting screw 60 and also position-adjusted.

That is, the movable supporting plate 40 is raised with its horizontal attitude being maintained by the slice width adjusting dial 60, and in accordance with the engaged state between the screw portion 62 and the screw receiving hole 13, the slide width adjusting dial 60 is position-determined at a desired position in the height direction H so that as shown in FIGS. 6A to 6D, since the movable supporting plate 40 is raised/lowered, with its horizontal attitude being maintained, depending on the position of the slice width adjusting dial 60, it is possible to slice the material to be sliced with a uniform thickness regardless of the size of the material to be sliced.

Moreover, since the slice width adjusting dial 60 is made in contact with the rear surface 40*c* of the movable supporting plate 40, and supports it without any gap, cut chips and waste water are prevented from remaining between the slice width adjusting dial 60 and the movable supporting plate 40; therefore, the slicer 1 can be used sanitarily.

Furthermore, since the first rib 45 is placed on the rear surface 40*c* of the movable supporting plate 40, the rigidity of the movable supporting plate 40 is increased so that it becomes possible to suppress the movable supporting plate 40 from being deflected downward by receiving a pressing force exerted when the movable supporting plate 40 slices the material to be sliced.

In this manner, the slicer 1 in accordance with the present embodiment makes it possible to horizontally raise or lower the movable supporting plate 40 while the deflection of the movable supporting plate 40 is being suppressed; thus, it becomes possible to slice the material to be sliced with a uniform thickness regardless of the size of the material to be sliced and since it is possible to suppress cut chips and waste water from remaining, it becomes possible to use the slicer sanitarily.

Additionally, in the present invention, various modifications may be made within the scope without departing from the gist of the present invention, and those modifications are of course included within the scope of the present invention.

EXPLANATIONS OF REFERENCE NUMERALS

1 SLICER
10 FRAME
10*a* ATTACHING hole
10*b* OUTSIDE SURFACE
10*c* BOLT COMMUNICATION HOLE
11 SUPPORTING ARM
11*a* SLIT
11*b* GUIDE GROOVE
12 STAY
13 SCREW RECEIVING HOLE
14 HANDLE
20 SLICING BLADE
30 FIXED SUPPORTING PLATE
30*a* SURFACE (OF FIXED SUPPORTING PLATE)
31 GROOVE PORTION (OF FIXED SUPPORTING PLATE)
40 MOVABLE SUPPORTING PLATE
40*a* SIDE FACE
40*b* SURFACE (OF MOVABLE SUPPORTING PLATE)
40*c* REAR SURFACE
41 GUIDED PIN
42 GROOVE PORTION (OF MOVABLE SUPPORTING PLATE)
43 Tip PORTION
44 REAR END PORTION
45 FIRST RIB
46 SECOND RIB
50 EXCHANGE BLADE
60 SLICE WIDTH ADJUSTING DIAL
61 MAIN BODY UNIT
61*a* TOP SURFACE
63 HANDLE
70 ANTI-SLIPPING MEMBER
100 SLICE WIDTH ADJUSTING MECHANISM
B1 BOLT
S SLICING DIRECTION
W WIDTH DIRECTION
H VERTICAL DIRECTION
R EASILY DEFLECTING REGION
r1 TIP REGION
r2 CENTER REGION
r3 REAR END REGION

What is claimed is:

1. A slicer comprising:

a frame;

a slicing blade with two ends thereof being supported by the frame;

a movable supporting plate that supports a material to be sliced when the material to be sliced is moved to slide toward the slicing blade; and a slice width adjusting mechanism capable of adjusting a slicing width of the material to be sliced by raising or lowering the movable supporting plate relative to the slicing blade, wherein the slice width adjusting mechanism comprises: a slice width adjusting dial that has a cylinder shape having a screw portion formed on an outer peripheral surface, and is capable of supporting a rear surface of the movable supporting plate horizontally;

a screw receiving hole that is integrally formed with the frame and capable of being engaged with the screw portion; and a rib that is formed in the movable supporting plate to stand on the rear surface of the movable supporting plate and fitted into the slice width adjusting dial, wherein a top surface of the cylinder shape of the slice width adjusting dial when moved towards the movable supporting plate contacts the rear surface of the movable supporting plate moving the movable supporting plate forming a gap between the slicing blade and the movable supporting plate and a combination of the rib and the top surface increases rigidity of the movable supporting plate adjacent the slicing blade, whereby the movable supporting plate is suppressed from moving downward upon receipt of a pressing force exerted during slicing so as to maintain the gap providing consistent slices.

2. The slicer according to claim 1, wherein the movable supporting plate comprises: an easily deflecting region in which a front portion thereof in a slicing direction in which the material to be sliced is allowed to slide upon slicing the material to be sliced is formed with a narrowed width along the slicing direction, with at least one portion of the slicing width adjusting dial being arranged to support the inside of the easily deflecting region.

3. The slicer according to claim 1, wherein the movable supporting plate comprises: an easily deflecting region in which a front portion thereof in a slicing direction in which the material to be sliced is allowed to slide upon slicing the material to be sliced is formed with a narrowed width along the slicing direction, with at least one portion of the rib being disposed inside the easily deflecting region.

4. The slicer according to claim 1, wherein the frame is provided with a guide groove formed into a concave shape along a direction perpendicular to the inner peripheral surface, and the movable supporting plate has a guide pin that is formed on each of two sides in the width direction orthogonal to the slicing direction and is capable of being engaged with the guide groove.

5. The slicer according to claim 4, wherein the guide groove is formed on a rear surface in a direction perpendicular to the frame so as to be opened therefrom, with the guide pin of the movable supporting plate being attachably detached from the guide groove through the opening of the guide groove.

6. The slicer according to claim 1, wherein the movable supporting plate is divided into three equal portions, that is, a tip region, a center region, and a rear end region, successively from the tip side to the rear end in the slicing direction, the rib is formed in a manner so as to bridge over the tip region and the center region.

7. A slicer comprising:

a frame having opposing supporting arms with a longitudinal length, said frame having a guide groove formed in each one of the opposing supporting arms;

a fixed supporting plate extending between the opposing supporting arms over a first portion of the longitudinal length;

a stay extending between the opposing supporting arms in a second portion of the longitudinal length, said stay having a screw receiving hole therein;

a movable supporting plate having a tip region, a center region, and a rear end region;

opposing guide pins formed in said movable supporting plate and placed adjacent the rear end region;

a rib extending perpendicularly from said movable supporting plate adjacent the tip region;

said movable supporting plate placed over the second portion of the longitudinal length and said stay between the opposing supporting arms, wherein said rib extends through the screw receiving hole and one each of said opposing guide pins fits within a respective one of the guide groove formed in each one of the opposing supporting arms;

a slicing blade attached to said frame placed between said fixed supporting plate and said movable supporting plate;

a slice width adjusting dial having a cylindrical body with a top surface and a screw portion formed on an outer cylindrical peripheral surface of the cylindrical body, the screw portion mating with the screw receiving hole in said stay extending between the opposing support arms; and wherein said rib extends within the cylindrical body of said slice width adjusting dial and as said slice width adjusting dial is rotated the cylindrical body of said slice width adjusting dial is drawn towards said movable supporting plate until the top surface contacts said movable supporting plate causing said movable supporting plate to move, whereby said movable supporting plate is moved by contacting the top surface of the cylindrical body of said slice width adjusting dial causing a gap to be formed between said movable supporting plate and said slicing blade and providing support for said movable supporting plate increasing the rigidity of said movable supporting plate adjacent the tip region suppressing the tip region from moving downward upon receipt of a pressing force exerted during slicing so as to maintain the gap providing consistent slices.

* * * * *